US005406129A

United States Patent [19]

Gilmartin et al.

[11] Patent Number: 5,406,129

[45] Date of Patent: Apr. 11, 1995

[54] FLASHING LOCATOR SWITCH CONTROL WITH BUILT-IN LAMP OPERATION TEST

[75] Inventors: Brian W. Gilmartin; Frank J. Gilmartin, both of Monroe, Ohio

[73] Assignee: CPX Industries, Inc., Cincinnati, Ohio

[21] Appl. No.: 264,189

[22] Filed: Jun. 22, 1994

Related U.S. Application Data

[63] Continuation of Ser. No. 995,165, Dec. 22, 1992, abandoned, which is a continuation-in-part of Ser. No. 959,741, Oct. 13, 1992, abandoned.

[51] Int. Cl.[6] ..... G08B 7/00

[52] U.S. Cl. ..... 307/125; 307/132 E; 361/156; 340/331

[58] Field of Search ..... 307/356, 632, 113–115, 307/125, 139, 132 E, 141, 141.4; 340/329, 331, 332; 315/200 A; 361/156, 195, 196–198, 203, 205

[56] References Cited

U.S. PATENT DOCUMENTS

| | | | |
|---|---|---|---|
| 2,082,789 | 6/1937 | Chase . | |
| 2,888,669 | 5/1959 | Thomas et al. . | |
| 2,911,637 | 11/1959 | Wortmann . | |
| 2,983,812 | 5/1961 | Ashe . | |
| 3,047,773 | 7/1962 | Morton . | |
| 3,058,032 | 10/1962 | Woodward . | |
| 3,287,722 | 11/1966 | Craig . | |
| 3,422,279 | 1/1969 | Rowell | 307/132 M |
| 3,599,201 | 8/1971 | Clardy et al. . | |
| 3,624,635 | 11/1971 | Less . | |
| 3,631,318 | 12/1971 | Hubbard . | |
| 3,725,834 | 4/1973 | Dorsey et al. . | |
| 3,728,713 | 4/1973 | Alten . | |
| 3,810,149 | 5/1974 | Miller et al. . | |
| 3,814,948 | 6/1974 | Schuchmann et al. | 307/141 |
| 3,860,910 | 1/1975 | Hudson . | |
| 3,863,236 | 1/1975 | Clardy . | |
| 3,911,425 | 10/1975 | Muncheryan . | |
| 3,913,092 | 10/1975 | Klingenberg | 340/331 |
| 3,999,176 | 12/1976 | Kellogg et al. . | |
| 4,003,040 | 1/1977 | Browand . | |
| 4,074,244 | 2/1978 | Balderson . | |
| 4,177,408 | 12/1979 | Mason . | |
| 4,254,405 | 3/1991 | Wenzlaff . | |
| 4,276,542 | 6/1981 | Russ . | |
| 4,290,057 | 9/1981 | Knight . | |
| 4,479,170 | 10/1984 | Richardson . | |
| 4,499,453 | 2/1985 | Right . | |
| 4,547,761 | 10/1985 | Jones . | |
| 4,556,863 | 12/1985 | Devitt et al. . | |
| 4,570,155 | 2/1986 | Skarman et al. . | |
| 4,587,753 | 5/1986 | Harper . | |
| 4,611,265 | 9/1986 | Davis | 362/145 |
| 4,634,957 | 1/1987 | Hollaway . | |
| 4,642,477 | 2/1987 | Grzanowski et al. . | |
| 4,686,505 | 8/1987 | Vanderburg . | |
| 4,730,184 | 3/1988 | Bach | 340/691 |
| 4,739,187 | 4/1988 | Nelson et al. . | |
| 4,839,630 | 6/1989 | Miller . | |
| 4,855,723 | 8/1989 | Fritz et al. . | |
| 4,881,058 | 11/1989 | Berry, III . | |
| 4,901,461 | 2/1990 | Edwards et al. . | |
| 4,931,780 | 6/1990 | LaMont et al. | 340/331 |
| 4,967,177 | 10/1990 | Nguyen . | |
| 4,983,960 | 1/1991 | Dunn . | |
| 5,070,327 | 12/1991 | Ellingson . | |
| 5,155,470 | 10/1992 | Tuttle . | |

OTHER PUBLICATIONS

When Every Second Counts, First 5 Home Lifesaving Kit (Brochure), Consumer Engineering, Inc., Palm Bay Florida, date unknown.

Chrisis-Lite (brochure), Creative Products, Apollo, Pa., date unknown.

*Primary Examiner*—A. D. Pellinen
*Assistant Examiner*—Fritz M. Fleming
*Attorney, Agent, or Firm*—Wood, Herron & Evans

[57] ABSTRACT

A flashing locator switch control includes an audible alert circuit with the switch and flasher to provide assurance to the user that the outside light is operating to flash on and off and by which to test the outside light at any time day or night.

15 Claims, 2 Drawing Sheets

FLASHING LOCATOR SWITCH CONTROL WITH BUILT-IN LAMP OPERATION TEST

RELATED APPLICATIONS

This application is a continuation of our application Ser. No. 07/995,165 filed Dec. 22, 1992 (now abandoned), which is a continuation-in-part of our application Ser. No. 07/959,741, filed Oct. 13, 1992 (now abandoned). This application is a continuation of our application Ser. No. 07/959,741 filed Oct. 13, 1992.

BACKGROUND OF THE INVENTION

I. Field of the Invention

The present invention relates to flashing locator switch control systems and more particularly to such systems useful for turning an outdoor light, for example, on, off or into a flashing mode, the latter for aiding others to quickly locate a particular dwelling, especially at night.

II. Description of the Prior Art

Oftentimes, an emergency distress call is made requiring that emergency medical, police, and/or fire personnel quickly locate a particular dwelling where help is needed. To find that dwelling, the emergency personnel must typically try to locate a specific address number. Oftentimes the number is not easily visible from the street so help is delayed. When such calls are made at night, there may be even greater difficulty in locating the correct address.

To overcome such problems, it has been proposed to replace the existing two-position (on/off) switch which is conventionally employed from inside the home to turn the outside light (such as a lamppost light, for example) on and off with a three-position flashing locator switch control system. Such a system includes a flasher circuit such that in addition to being able to turn the light on and off in conventional manner, the switch includes a third "flashing mode" position which activates the flasher circuit to cause the outside light to repeatedly flash on and off. As they travel down the street looking for the correct address, the emergency personnel responding to the scene may have their attention drawn immediately to the flashing light and thus have a better chance to locate the correct dwelling in a hurry. But there are a couple of drawbacks with previously proposed flashing locator switch control systems.

It will be appreciated that those who may have need to place the system in the flashing mode may be in a state of panic and perhaps in a state of diminished capacity, both physically and emotionally. As a consequence, it becomes important to such individuals to know that help is on the way. Unfortunately, the individual may not be in a position to readily see or perceive that the light has begun flashing. Or, in some cases, the outside light may simply not be situated where it can be readily seen from the vicinity of the switch. In either event, the individual may not know for sure that the system has been activated and thus may feel greater panic and aggravate the situation.

Still further, many users of such flashing locator switch control systems need to know the system is fully operational in the event its use is needed. Thus, it is important to know that the outside light is not burnt out, for example. One way of testing whether the light is working might involve simply turning the outside light on and looking to see if it is lit. If the light is difficult to see due to its positioning, such a visual test is hardly satisfactory and may even prove unduly difficult. Indeed, it is typical to perform such a test during the daytime when it is easier, and safer, to go outside to view the light to see if it is lit, and/or to change the bulb if it is not working. But, obviously, testing in the daytime makes viewing the light that much more difficult since it is difficult to determine whether the bulb is actually on.

SUMMARY OF THE INVENTION

The present invention provides a flashing locator switch control system that overcomes such drawbacks. More specifically, the present invention includes a mechanism by which to immediately assure the user that the "flashing mode" has been entered into and, further, to provide a way, from inside the dwelling, without even seeing the outside light, and at any time desired, to quickly and easily test whether the outdoor light is operating. To this end, and in accordance with the principles of the present invention, the flashing locator switch control system is provided with a buzzer circuit in series with the outdoor light but associated with the switch inside the dwelling which buzzer sounds only when the switch is in the "flashing mode" and the outdoor light is actively drawing current (such as occurs when the bulb filament is intact and can light up). Thus, when it becomes necessary to place the system in the flashing mode for others to be able to locate the dwelling, there is the immediate and certain psychological assurance that help is on the way when the buzzer sound emanates from the area of the switch. Additionally, the operability of the outdoor light may be quickly and easily tested by briefly placing the switch in the flashing mode. If the buzzer sounds, the light may be safely assumed to be working whereas if the buzzer does not sound, the bulb is probably burned out. This test may be done at any time, day or night, and irrespective of whether the user can even see the light from where the user stands to throw the switch.

By virtue of the foregoing there is thus provided a flashing locator switch control system which overcomes the above-described drawbacks of previously proposed systems.

These and other objects and advantages of the present invention shall be made apparent from the accompanying drawings and description thereof.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the principles of the invention.

DETAILED DESCRIPTION OF THE DRAWINGS

Figure 1:
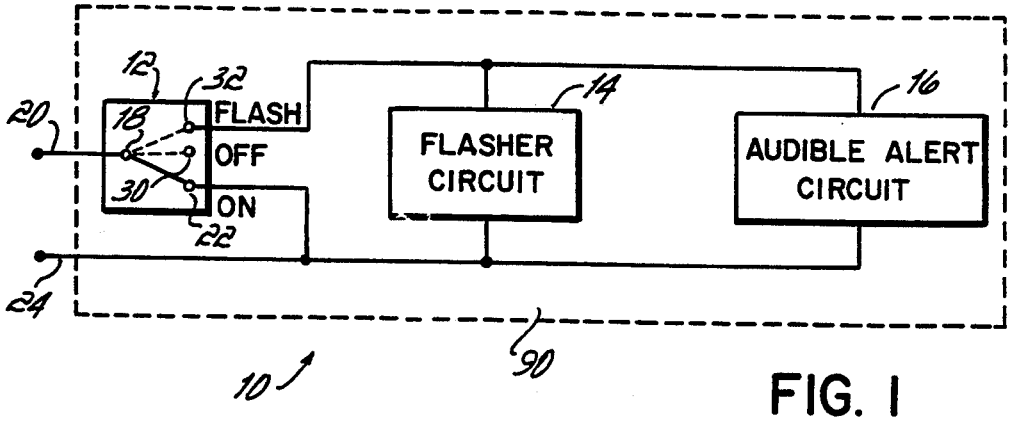
FIG. 1 is a block diagram of one embodiment of a flashing locator switch control system according to the principles of the present invention.

With reference to FIG. 1, there is shown a first embodiment of a flashing locator switch control system 10 comprising three-position switch 12 (such as a 16-amp, 125 V.A.C. rated switch available from Carling Switch Co., Part No. RC-211-PS-ON, or Arrow-Hart-Eaton, Inc., Part No. 1604-22E), flasher circuit 14 and audible alert circuit 16 interconnected together electrically and mechanically as will be described. The input contact 18 of switch 12 is connected to wire 20 and output contact 22 of switch 12 is connected to wire 24 such that when wires 20 and 24 are connected in series between wire 26, 27 to outside light 28 (see FIG. 3), light 28 will be turned on when switch 12 is in the "on" position to electrically interconnect contacts 18 and 22. Output contact 30 of switch 12 is not connected, directly or indirectly, to either wire 20 or 24 such that when switch 12 is placed in the "off" position to electrically interconnect contacts 18 and 30, light 28 will be off.

The third output contact 32 of switch 12 is indirectly connected to wire 24 through the parallel combination of flasher circuit 14 and audible alert circuitry 16 such that when switch 12 is placed into the "flash" position to electrically interconnect contacts 18 and 32, flasher circuit 14 is energized and light 28 will be repeatedly flashed on and off by action of flasher circuit 14. Additionally, current will flow through audible alert circuit 16 causing circuit 16 to sound an audible alert in the vicinity of switch 12 and thereby provide the desired assurance to the user that the light is flashing and help is on the way. Also, others nearby may hear the audible alert and come to the aid of the user. Additionally, if light 28 is not functioning (e.g., it is burned out), current will not flow through audible alert circuit and no audible alert will be given. This feature allows the user to know that light 28 is burned out and thus needs to be replaced. As a consequence, light 28 may be easily and quickly tested at any time, day or night, and without regard to whether light 28 is even visible from the location of switch 12.

Figure 2:
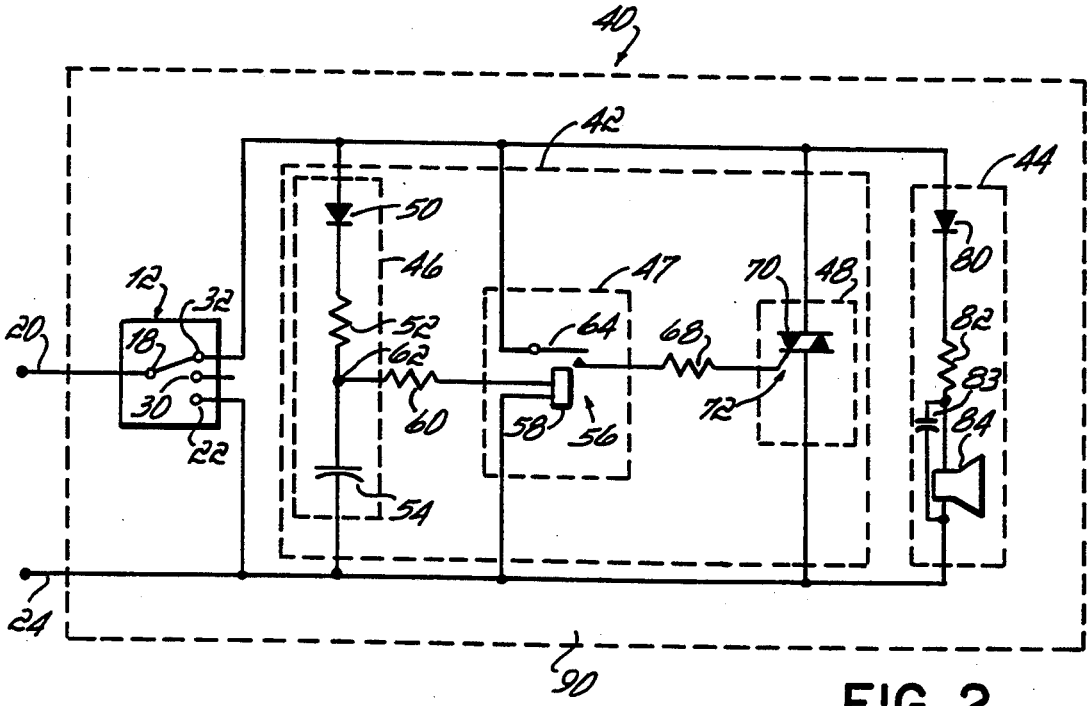
FIG. 2 is a schematic diagram of another embodiment of a flashing locator switch control system according to the principles of the present invention.

With reference to FIG. 2, there is shown a schematic diagram of another embodiment 40 of a flashing locator switch control system similar to system 10 and wherein like numbers refer to like components. System 40 includes three-position switch 12, flasher circuit 42 and buzzer circuit 44 with switch contact 32 indirectly connected to wire 24 through parallel circuits 42 and 44. Flasher circuit 42 includes three parallel circuit legs 46, 47, and 48 between contact 32 and wire 24. Circuit 46 is a flash timer circuit and includes in series diode 50, 4.7 kilohm (Kohm), ¼ watt, 5% resistor 52 and 100 microfarad capacitor 54. Leg 47 is a flash control leg and includes Reed relay 56 (Part Number MEH 31-1412 available from NAI, Inc. or Part Number LG 400-112 available from Standex, Inc.), the solenoid 58 of which is connected in series with 4.7 Kohm, ¼ watt, 5% resistor 60 between node 62 of resistor 52 and capacitor 54 in timer leg 46 and wire 24 by which to open and close relay switch 64. Relay switch 64 is connected between switch contact 32 and 1 Kohm, ¼ watt, 5% resistor 68 to provide power to lamp switch leg 48 when switch 64 is closed as will be described. Third leg 48 includes triac 70 (such as Part No. Q4004L4, available from Teccor Corp. or Power-X Corp.) which is gated on by AC voltage at its gate input 72 from resistor 68 under control of flash control leg 47. System 40 further includes buzzer circuit 44 comprised of the series circuit of diode 80, 10 Kohm, ½ watt, 5% resistor 82 and the parallel combination of 33 microfarad capacitor 83 and buzzer 84 (such as Part No. TMB12 available from Star Micronics, Inc., or Part No. AI165 or AI155 available from Projects Unlimited, Inc.) which sounds in response to current flowing through circuit 44 which occurs only when switch 12 is in the flash position and light 28 is not burned out.

With switch 12 in the flash position, AC current flows through contact 32 and is half-wave rectified by diode 50 to charge up capacitor 54 at a rate determined by the RC time constant of resistors 52 and 60 and capacitor 54. When capacitor 54 is sufficiently charged such that current flow through solenoid 58 is large enough to pull in normally open switch 64 (and thus close same), AC voltage will be coupled from contact 32 to the gate input 72 of triac 70. That input voltage will cause triac 70 to close like a switch allowing AC current to flow directly from contact 32 into wire 24 to turn light 28 on. While triac 70 is closed, there is, in effect, a short circuit across timer leg 46 such that capacitor 54 is no longer being charged but instead discharges through resistor 60 and solenoid 58 until such time as there is too little current flowing through solenoid 58 to hold relay switch 64 closed. At that time, solenoid 58 will release its pull and allow switch 64 to open, causing triac 70 to lose input voltage at gate 72 such that triac 70 will thereafter shut off or open and cause light 28 to go off (or at least to reduce substantially in intensity since current through buzzer circuit 44 may still at least warm the filament 86 (FIG. 3) of light 28). Light 28 will be off until capacitor 54 is again charged and the above process will repeat to then cause light 28 to repeatedly flash on and off.

Similarly, AC current is coupled to buzzer circuit 44 and is half-wave rectified by diode 80 to thus cause buzzer 84 to sound. During those times that triac 70 is on, circuit 44 will be effectively short-circuited such that insufficient current flows through buzzer 84 to allow it to sound (or it may sound at a very low and barely audible level). The result is to desirably provide an intermittent buzzer sound so as to "flash" like light 28. Typically, when light 28 is on, buzzer 84 is off and vice versa.

Figure 3:
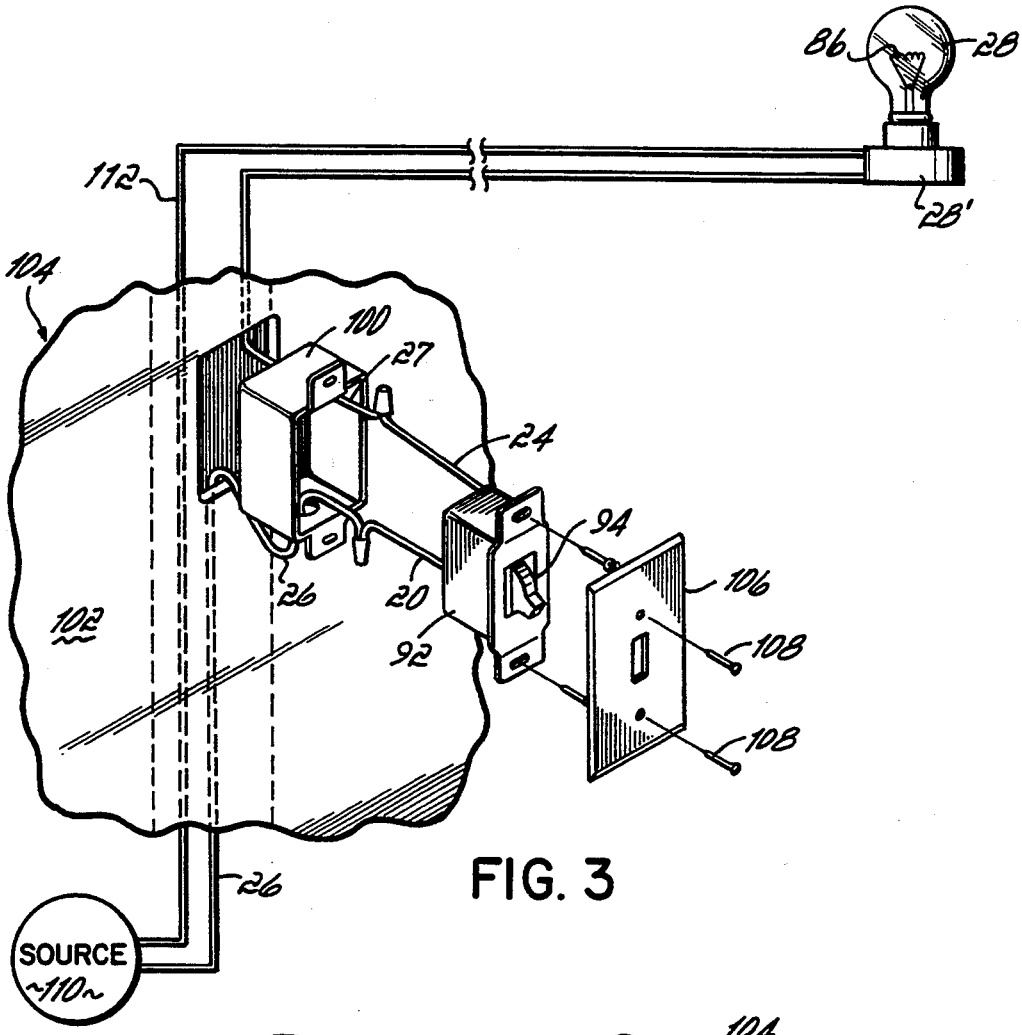
FIG. 3 is a perspective exploded view of the system of FIG. 2 being placed into a building structure.

To facilitate ease of installation of system 10 or 40, switch 12 and circuits 14 and 16 or 42 and 44 are mounted to a common PC board 90 with the various components interconnected by copper traces thereon as is conventional. As seen in FIG. 3, board 90 and its mounted components may be contained within a housing 92 with only the handle 94 of switch 12, and wires 20, 24 being accessible outside of housing 92.

System 40 is easily installed by connecting wires 20 and 24 in series between the white wire 26 and black wire 27, respectively, as is typically found inside the junction box 100 in the wall 102 of dwelling 104. A faceplate 106 may then be mounted over housing 92 by screws 108 as is conventional. Wires 26 and 27 are in series between the AC source of power 110 into dwelling 104 and light 28 with another, typically electrically uninterrupted, wire 112 connected between source 110 and light 28 so that a closed loop of AC power is possible to turn light 28 on as desired. To this end, and as clearly shown in FIG. 3, wire 112 provides a direct electrical connection to the outside light socket 28' without further alarm circuitry, and socket 28' in turn makes a direct electrical and mechanical connection with bulb 28.

Figure 4:
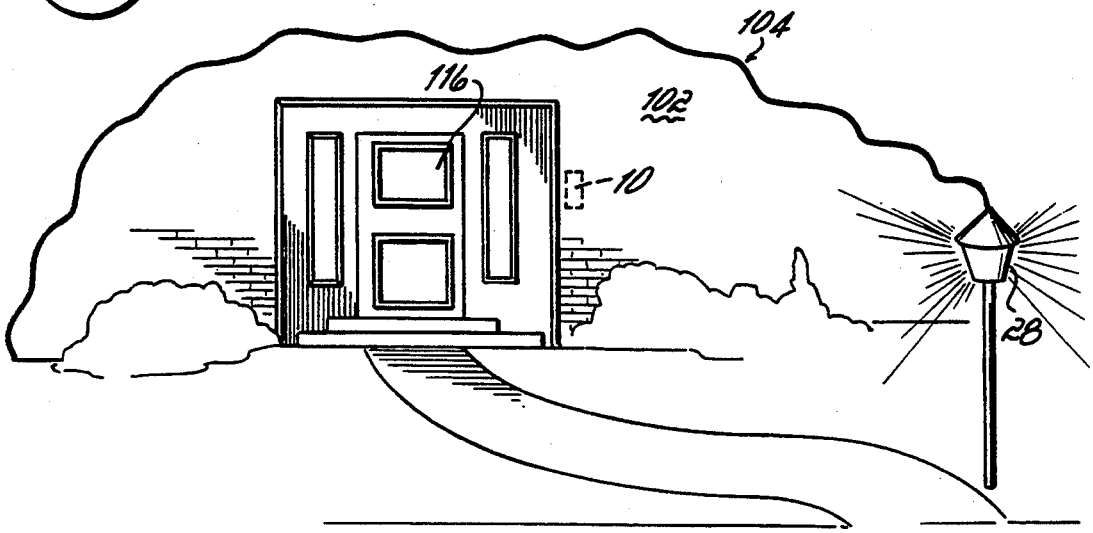
FIG. 4 is a schematic view of a dwelling and outdoor light for purposes of explaining the principles of operation of the present invention.

In use, and as may be understood by reference to FIG. 4, flashing locator switch control system 40 (or 10) may typically be located on wall 102 within dwelling 104 at or near front door 116 thereof. In normal use, the on and off positions of switch 12 are typically employed to turn light 28 on at night and off during the day, for example. In either position of switch 12, the flasher and buzzer circuits are not activated. To test light 28, the user (not shown) places switch 12 in the flash position and listens for the audible sound from audible alert circuit 16 or buzzer 84. If the sound is heard, then light 28 is presumed to be operating and switch 12 is placed back into the off position. If no sound is heard, then light 28 is likely burned out and must be replaced. As the test of light 28 relies on sound at the location of switch 12 and not on visual sight of light 28, the foregoing test may be undertaken at any time and irrespective of whether light 28 is even visible from the location of switch 12. Indeed, for safety's sake, the user need not open the door or step outside to see light 28 in order to have reasonable assurance that it is working. And, of course, anytime it is necessary to provide the ability to help others locate dwelling 104, such as when emergency personnel are responding, for example, placing switch 12 in the flash position provides not only the flashing outside light to facilitate quick location of the building, the buzzer is also sounded to provide the desired assurance and peace of mind that help is on the way. Additionally, the buzzer sound may help alert others in the dwelling to the existence of a possible emergency situation.

By virtue of the foregoing, there is thus provided a flashing locator switch control system which advantageously provides an audible indicator within the dwelling for the dual purpose of providing assurance that help is on the way and to provide a quick and easy way to test whether the outside light is burned out.

While the present invention has been illustrated by the description of embodiments thereof, and while the embodiments have been described in considerable detail, it is not the intention of applicant to restrict or in any way limit the scope of the appended claims to such detail. Additional advantages and modifications will readily appear to those skilled in the art. For example, switch leg 70 of flasher circuit 42 could be eliminated and relay switch 64 coupled directly between switch contact 32 and wire 24 if relay 56 is sturdy enough. Additionally, a light could also be provided with the switch system to indicate that the switch is in the flash mode. The invention in its broader aspects is therefore not limited to the specific details, representative apparatus and method, and illustrative examples shown and described. Accordingly, departures may be made from such details without departing from the spirit or scope of applicant's general inventive concept.

What is claimed is:

1. A method of controlling a light bulb in a light socket outside a dwelling with a flashing locator switch control system inside the dwelling, the system including a three-position switch having a power input and at least first and second power outputs, the power input being connected directly via the switch to the first power output in an on position of the switch and to the second power output in a flash position of the switch, the power outputs being disconnected from the power input in an off position of the switch, the method comprising:

placing the switch within the dwelling:

electrically connecting the switch power input to a first power supply wire;

interconnecting within the dwelling and between the first and second power outputs of the switch alarm circuitry including a flasher circuit and an audible alert circuit;

providing direct electrical wire connection between the light socket outside the dwelling and each of the switch first power output and a second power supply wire;

inserting a light bulb in the light socket so as to make direct electrical and mechanical connection therebetween and to make direct electrical connection to the switch and the alarm circuitry and without any further alarm circuitry outside the dwelling;

placing the switch in the off position to interrupt current to the outside light socket and the audible alert circuit such that the audible alert circuit is not energized to generate an audible alert sound:

placing the switch in the on position to supply current to the outside light socket via the direct electrical connection to cause the light bulb in the socket outside the dwelling to turn full on;

placing the switch in the flash position to supply current intermittently to the outside light socket via the direct connection to cause the light bulb in the socket outside the dwelling to repeatedly flash on and off and the audible alert circuit to generate an audible alert sound in the dwelling if the outside light bulb in the socket is not burned out and there is no open circuit preventing current from flowing through the audible alert circuit;

interconnecting the flasher circuit and the audible alert circuit such that in the flash position of the switch the audible alert circuit periodically emits the audible alert sound while the outside light bulb is being flashed on and off; and listening when the switch is in the flash position for the audible alert sound absence of which indicates that the direct electrical connection is open and the outside light bulb may have burned out.

2. The method of claim 1 further comprising:

interconnecting the flasher circuit and audible alert circuit in parallel with one another.

3. The method of claim 1 further compromising effectively short circuiting the audible alert circuit when the outside light is flashing on.

4. The method of claim 1 further comprising:

providing in the flasher circuit a timer circuit leg and a flash control leg; and connecting the timer circuit leg and flash control leg such that they cooperate to repeatedly flash the outside light on and off.

5. The method of claim 1 further compromising:

charging up a capacitor;

closing a switch between the source of power and the outside light in response to the capacitor being charged up to flash the light on;

discharging the capacitor;

opening the switch to flash the light off; and repeating the aforesaid sequence of charging, closing, discharging and opening.

6. The method of claim 5 further comprising:

providing a relay solenoid for opening and closing the switch; and discharging the capacitor through the relay solenoid.

7. A self-contained flashing locator switch control system with self-test feature for turning full on or flashing a light bulb in a light socket outside a dwelling comprising:

a three-position switch having a power input coupled to a first power supply wire and at least first and second power outputs, the power input being connected via the switch to the first power output in an on position of the switch and to the second power output in a flash position of the switch, the power outputs being disconnected from the power input in an off position of the switch;

a connecting wire having opposite ends and being electrically connected at one end to the first power output and at the other end directly to the outside light socket which, in turn, is directly electrically connected to a second power supply wire;

a flasher circuit and an audible alert circuit electrically connected between the first and second power outputs;

the switch, flasher circuit and audible alert circuit being configured to be mounted proximate one another inside a dwelling and being interconnected together mechanically and electrically such that when a light bulb is inserted into the socket to make direct electrical and mechanical connection therewith, the light bulb makes a direct electrical connection to the switch, flasher circuit and audible alert circuit without any further alarm circuitry outside the dwelling and further such that (a) in the off position of the switch, power is not provided via the switch to the outside light socket and the audible alert circuit such that the audible alert circuit is not energized to generate an audible alert sound, (b) in the on position of the switch the power input is coupled to the connecting wire to supply current to the outside light socket via the direct connection to cause the outside light bulb in the socket to turn full on, and (c) in the flash position of the switch the power input is coupled to the flasher and audible alert circuits to supply current intermittently to the outside light socket via the direct connection to cause the outside light bulb in the socket to flash on and off while the audible alert circuit generates an audible alert sound in the dwelling in the vicinity of the switch if the outside light bulb in the socket is not burned out and there is no open circuit preventing current from flowing through the audible alert circuit, the flasher circuit and audible alert circuit being interconnected electrically such that in the flash position of the switch the audible alert circuit periodically emits the audible alert sound while the outside light bulb is being flashed on and off.

8. The flashing locator switch control system of claim 7, the audible alert circuit being in series with the outside light socket through the connecting wire direct electrical connection in the flash position of the switch such that if a light bulb in the outside light socket is burned out, the direct electrical connection is open and the audible alert circuit will not sound.

9. The flashing locator switch control system of claim 7, the flasher circuit and audible alert circuit being in parallel.

10. The flashing locator switch control system of claim 7, the flasher circuit including switch means for effectively short circuiting the audible alert circuit when the outside light is flashing on.

11. The flashing locator switch control system of claim 7, the flasher circuit including at least a timer circuit leg and a flash control leg, the flash control leg cooperating with the timer circuit leg to selectively open and close a circuit between a source of power and the outside light to repeatedly flash the outside light on and off.

12. The flashing locator switch control system of claim 11, the timer circuit leg including a capacitor, the timer circuit and flash control leg being interconnected such that the capacitor charges through the timer circuit leg and discharges through the flash control leg.

13. The flashing locator switch control system of claim 12, the flash control leg including a relay, the solenoid of which is coupled to the capacitor for discharging the capacitor through the solenoid.

14. The flashing locator switch control system of claim 11 wherein the circuit which is opened and closed includes a relay switch.

15. The flashing locator switch control system of claim 11 further comprising a switch leg including the circuit which is opened and closed, the circuit being responsive to a signal from the flasher control leg.

* * * * *